United States Patent [19]

Sigismonde

[11] Patent Number: 4,532,654

[45] Date of Patent: Aug. 6, 1985

[54] BLIZZARDKOAT

[75] Inventor: Michael Sigismonde, Sound Beach, N.Y.

[73] Assignee: Christopher B. Guzowski, Mt. Sinai, N.Y. ; a part interest

[21] Appl. No.: 616,806

[22] Filed: Jun. 4, 1984

[51] Int. Cl.[3] ..... A41D 23/00

[52] U.S. Cl. ..... 2/69.5; 2/97

[58] Field of Search ..... 2/69, 97, 69.5, 93, 2/108, 97

[56] References Cited

U.S. PATENT DOCUMENTS 1,454,541 5/1923 Falvey ..... 2/69

4,158,892 6/1979 Gonzales ..... 2/69.5

*Primary Examiner*—Doris L. Troutman

*Attorney, Agent, or Firm*—Leonard Belkin

[57] ABSTRACT

A convertible jacket having an extendable lining for fully enclosing the legs of the wearer under conditions of extreme cold. In one embodiment, openings in the lining for lining up with the openings into the sleeves are provided with closures. Closures are also provided for the lining when it is wrapped around the legs of the wearer.

5 Claims, 8 Drawing Figures

BLIZZARDKOAT

BACKGROUND OF THE INVENTION

This invention relates to a multipurpose jacket and more particularly to a jacket convertible into a garment for providing full body protection against cold weather.

The jacket when properly constructed, sometimes including a hood, is generally effective to protect the upper body against cold weather. A properly insulated jacket or coat is very effective when the weather is extremely cold. The jacket is readily removable, as well, so that it can be donned quickly when leaving a warm environment such as a house or office and entering a cold environment such as outdoors during cold weather. Conversely, when entering a warm environment the jacket is readily removable.

The lower part of the body, including the legs and extending up to the hips or waist, however, depending on the type of jacket which is available presents another kind of problem for the average person.

If one wears dress or garments covering the lower body extremities designed for cold weather, such as thermal underwear or insulated pants, the wearer becomes uncomfortable when he enters a heated building or vehicle, and such garments are not conveniently removable. If such protective garments are not worn, there are many circumstances when the coat or jacket is not adequate protection to the wearer. Examples of such situations include sitting outdoors during cold weather in a stadium observing a football game or sitting or lying quietly in wait for game during a hunting outing during the cold weather. Garments such as blankets or leg wrappings may be brought along to provide extra protection in those situations, but such garments are usually bulky, inconvenient to carry or use, and very often interfere with the activities being engaged in such as when rising for ovations or to make observations. In addition, there are occasions when one becomes unexpectedly exposed to extreme cold and is not prepared with the proper dress or the extra garments just described, for example, being stranded in an automobile during a blizzard or where fuel is exhausted in a remote location.

There have been previous efforts to produce articles of clothing which can provide added protection under certain adverse conditions. Examples of some of these are shown in U.S. Pat. Nos. 1,489,046, 2,322,451, 2,372,110, 2,911,648, 3,381,306, and 4,158,892. The garments and articles of clothing shown in these patents are generally awkward to wear and to convert into one of their alternative applications and furthermore in many cases they are so complicated that their very usefulness on a practical level must be questioned.

SUMMARY OF THE PRESENT INVENTION

The present invention overcomes or reduces many of the problems associated with previous efforts to produce multipurpose garments capable of adding when needed cold weather protection to the lower body extremities by providing a jacket with an extra lining which when extended affords such protection.

A preferred embodiment of this invention consists of an insulated jacket with a closeable front opening and sleeves, having an insulated lining attached along the bottom edge of said jacket and normally extending up the inside of the jacket with openings to correspond to the openings into the sleeves. When the lining is pulled out of the inside of the jacket so that it extends away from the latter it may be wrapped around the legs of the wearer to protect then against the cold. Provision is made to attach the joining edges of the lining as the legs are wrapped and to seal the openings for the arms. In addition, the jacket with the lining pulled out can serve as a blanket on a bed, if desired.

The arrangement is simple and easy to use and is always available at any time the necessity arises for full body coverage.

It is thus a principal object of this invention to provide a jacket which is convertible into full body protection in cold weather.

Other objects and advantages of this invention will hereinafter become obvious from the following description of the preferred embodiments of this invention.

DESCRIPTION OF THE PREFERRED EMBODIMENT

Figure 1:
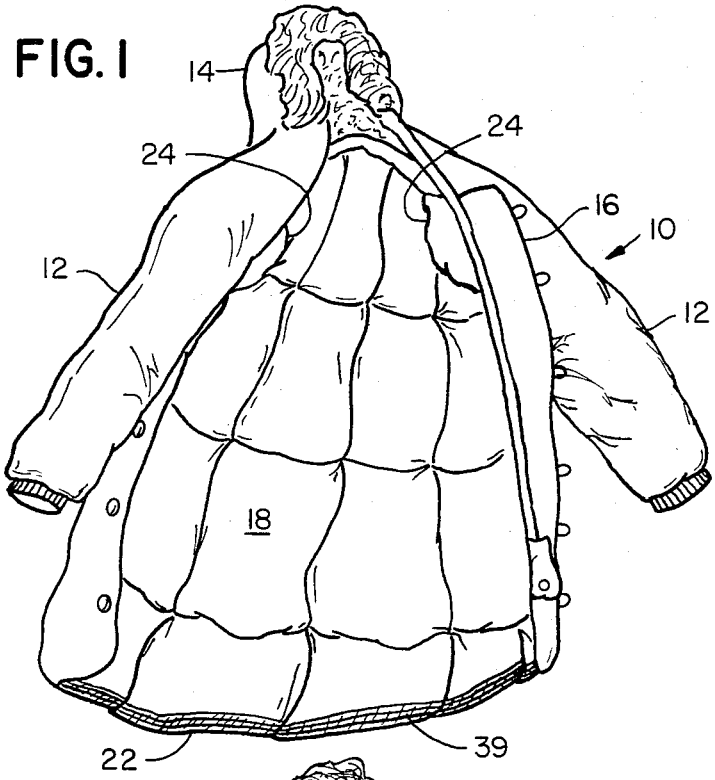
FIG. 1 is an isometric view of the jacket with the lining retracted.

Referring to FIG. 1 there is illustrated a jacket 10 with arms 12, a hood 14 and a closure 16 utilizing either or a combination of buttons, zippers, etc. for the wearer to close up the front. Insulated lining 18 is attached along the bottom edge 22 of jacket 10 and extends up into the interior of the latter with openings 24 corresponding to openings 26 into sleeves 12 shown in FIG. 2. Means may be provided to maintain lining 18 in its retracted position shown in FIG. 1, such as Velcro strips **28*a* and 28*b* on lining 18 and jacket 10**, respectively, or if desired and convenient, any other means may be utilized such as buttons, zippers, etc.

Figure 2:
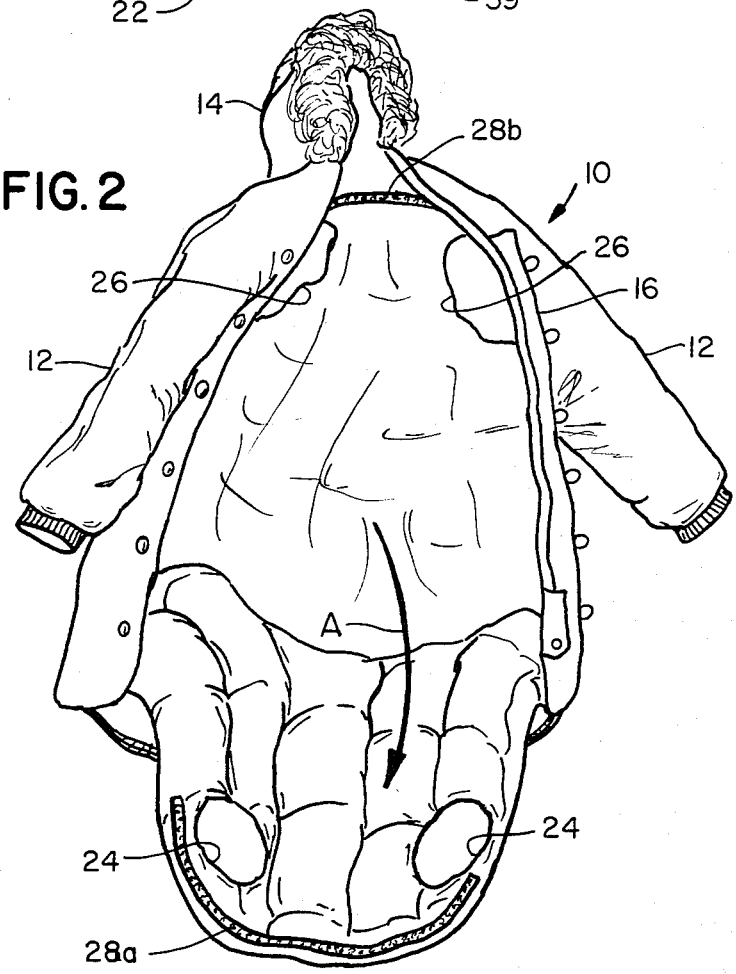
FIG. 2 shows the lining in the process of being extended.
Figure 3:
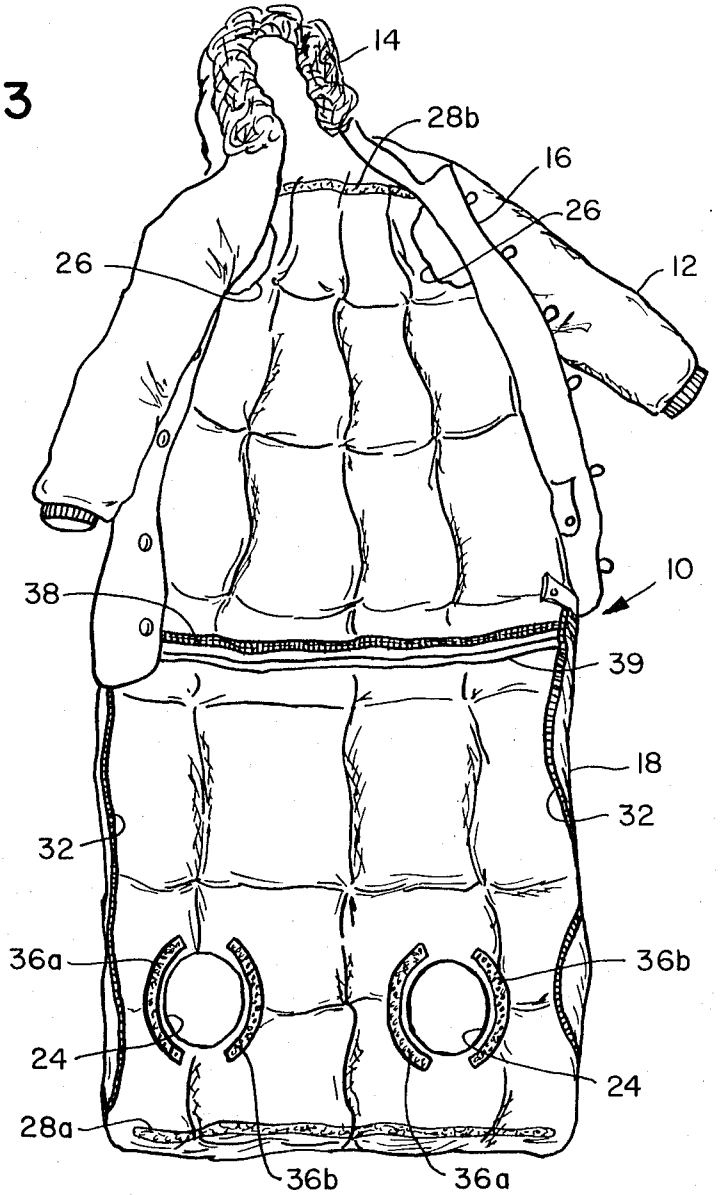
FIG. 3 shows the lining fully extended.

When it is desired to extend lining 18 for use in enclosing the lower body extremities, that is, the legs, hips, etc., as seen in FIGS. 2–5, lining 18 is pulled down as indicated by arrow A in FIG. 2 until it is extending its full length as shown in FIG. 3.

Figure 5:
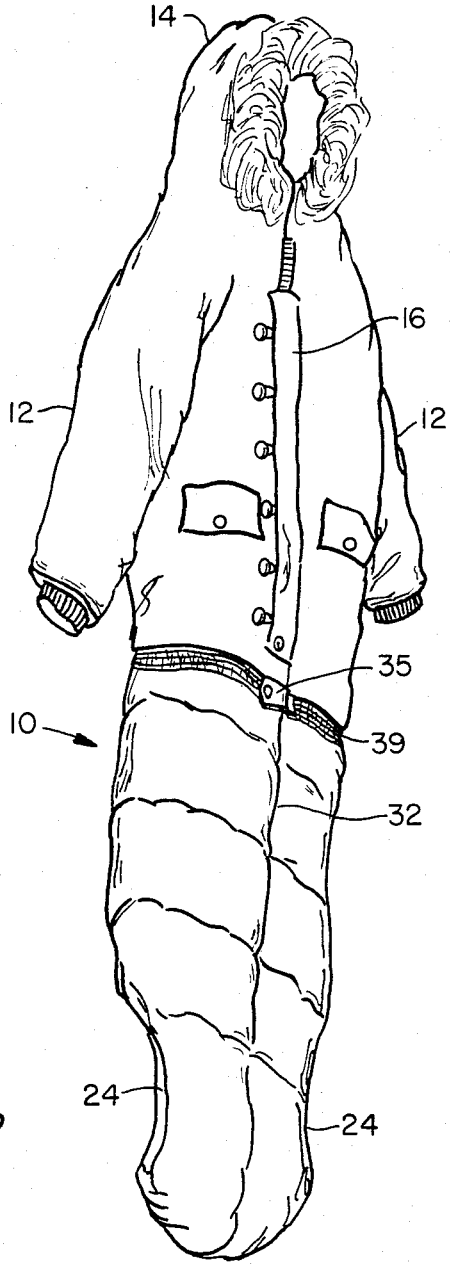
FIG. 5 shows the jacket fully secure with the lining extended.
Figure 4:
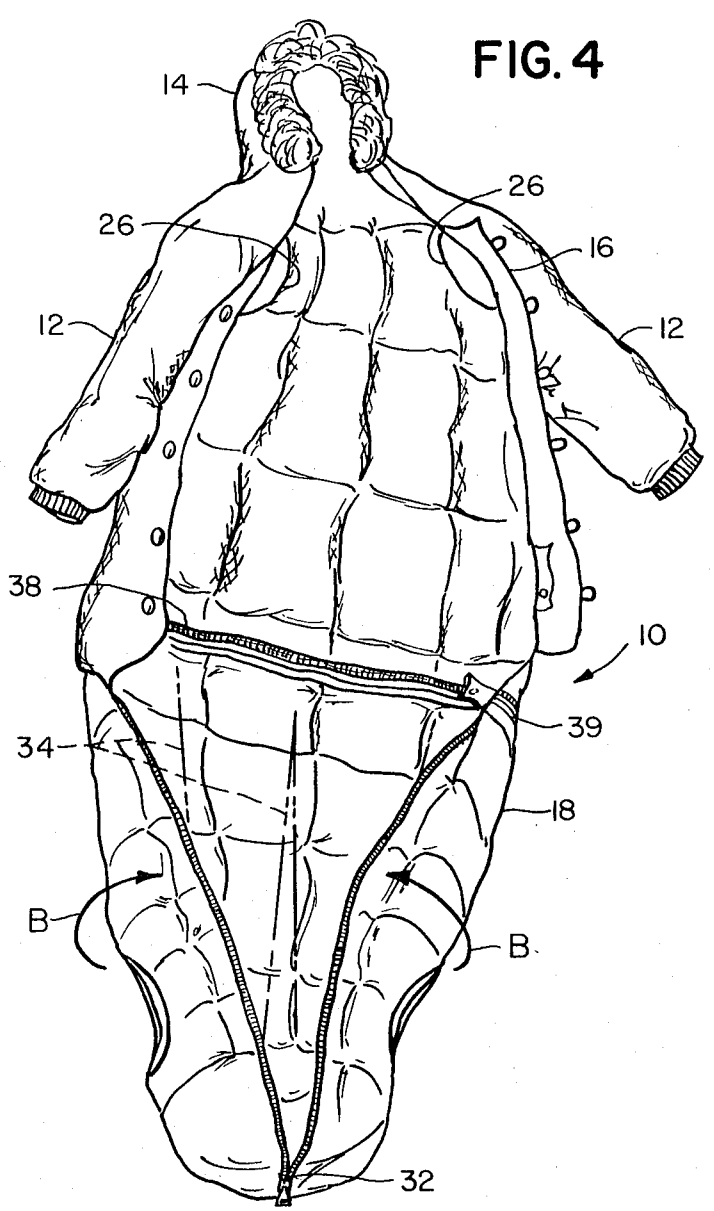
FIG. 4 shows the lining being wrapped around the legs of the wearer.

As shown by arrows B in FIG. 4, lining 18 is wrapped around the legs 34 of the wearer (shown in phantom) and a zipper 32 is provided to pull and hold lining 18 closed. It is understood that instead of zipper 32, buttons or Velcro fasteners may be employed. Jacket 10 and its lining 18 fully enclosing the wearer is illustrated in FIG. 5. Velcro strips **36*a* and 36*b* (shown in FIG. 3), or other convenient means, are provided to close openings 24, as illustrated in FIG. 3. Openings 24 are shown closed in FIG. 5. A zipper 38 may be employed as shown in FIG. 3 if it is desired to make lining 18 completely detachable. An elastic band or section 39** stretchable downwardly of convenient width may be prvided to accommodate persons with varying lengths of legs.

In the operation of jacket 10, it is seen that the jacket is readily available whenever needed for full body protection against cold weather by merely extending lining 18 as previously described. When the added protection is no longer necessary, lining 18 is readily tucked back inside of jacket 10. With the current availability of highly effective insulation not excessively bulky, such as down or foam, it is possible to construct jacket 10 with its lining 18 so that the former is only moderately bulky when worn.

In an alternative embodiment of this invention, the jacket incorporating the principles of this invention can be designed to permit the wearer when the lining is extended to remain mobile.

Figure 6:
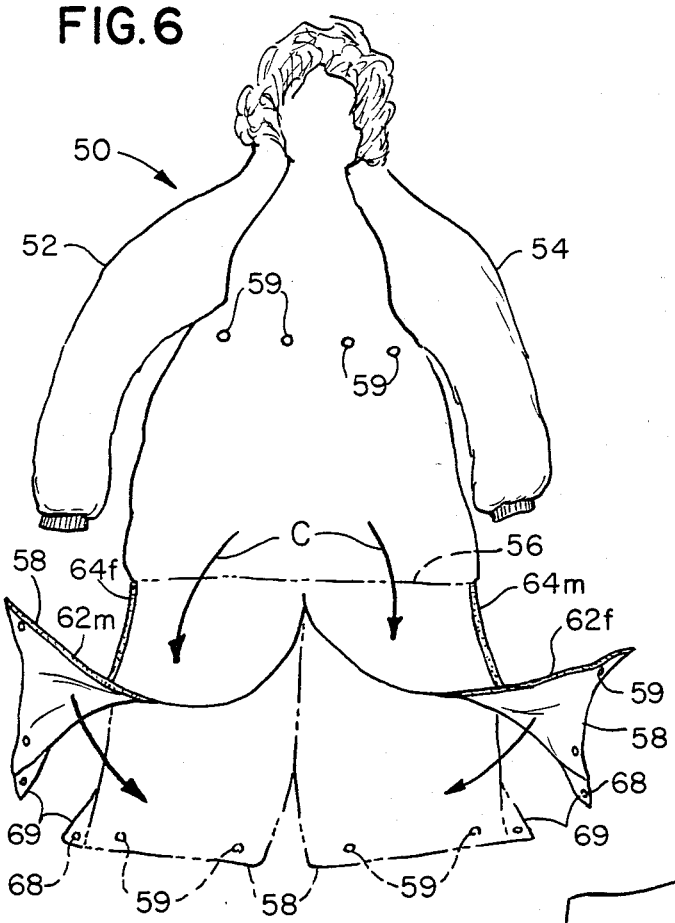
FIGS. 6, 7, and 8 show an alternative embodiment of this invention.
Figure 7:
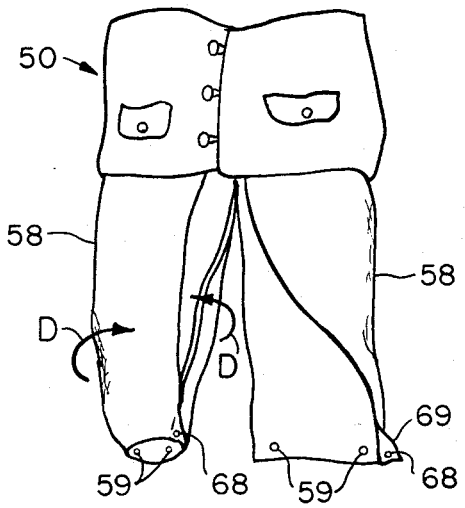
Figure 8:
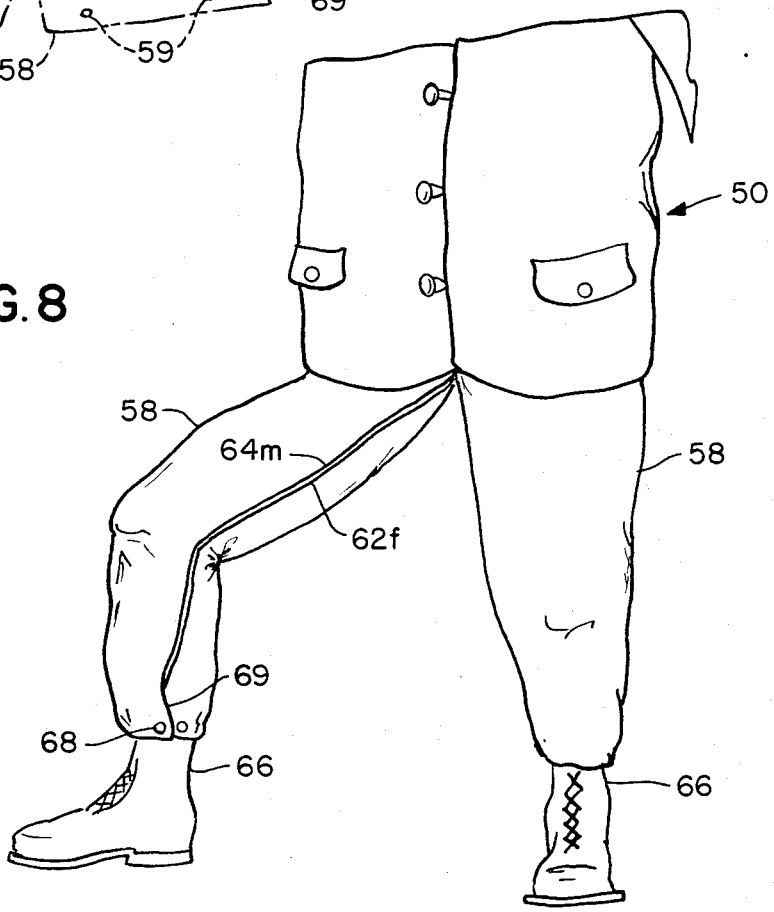

For details of this embodiment, reference is made to FIGS. 6, 7, and 8. Jacket 50 is shown open in FIG. 6 with sleeves 52 and 54, the front cut away to show the interior, bottom edge 56 and lining 58 which may be tucked into the inside of the jacket. Lining 58 when tucked into jacket 50 ends just below the arm pits so that no openings are required. Snaps 59 or Velcro connections, not shown, would be used to hold lining 58 in place when folded into the top portion of jacket 50.

Lining 58 is split down the middle so that there are two pairs of zippers 62*m* and 62*f* and 64*m* and 64*f*, m and f designating the male and female portions of the zippers.

When lining 58 is pulled down out of jacket 50, shown by arrow C, it is seen as shown in FIGS. 7 and 8, that the legs 66 of the wearer can be individually enclosed as shown by double arrow D with snaps 68 on flaps 69 if desired to close off the bottoms, thereby permitting the wearer to move around freely.

In all of the embodiments described it is seen that the jackets with linings extended and spread out flat can be used as blankets, an additional feature which adds to the usefulness of this invention.

While only preferred embodiments of this invention have been described it is understood that many variations thereof are possible without departing from the principles of this invention as defined in the claims which follow.

What is claimed is:

1. In an insulated jacket having a front opening and sleeves, and means to close and unclose said front opening about the upper body portion of the wearer of said jacket, the improvement comprising an insulated lining attached along the bottom edge of said jacket and normally extending up the inside of said jacket, said lining having openings to correspond with the openings into said sleeves, means to maintain during normal wear of said jacket said lining in its upwardly extending position, and means on said lining when the latter is pulled out of said jacket to extend away from the latter to wrap around the legs of said wearer and to maintain said lining in its wrapped position around said legs.

2. The jacket of claim 1 having means to close the openings in said lining when extended out of said jacket.

3. The jacket of claim 1 in which said lining is provided with an elastic section to permit lengthening of said lining when extended to enclose the legs of said wearer.

4. The jacket of claim 3 having a hood.

5. In an insulated jacket having a front opening and sleeves, and means to close and unclose said front opening about the upper body portion of the wearer of said jacket, the improvement comprising an insulated lining attached along the bottom edge of said jacket and normally extending up the inside of said jacket, said lining ending below the openings into the sleeves of said jacket, means to maintain during normal wear of said jacket said lining in its upwardly extending position, said lining split into a pair of elongated segments and joined by a zipper when in its upwardly extending position, and additional zippers along the outer edges of the segments to permit each segment or said lining when extended and zippered apart from each other to wrap around one leg of said wearer and be zippered closed thereby forming leggings.

* * * * *